US012042834B2

(12) United States Patent
Schnug

(10) Patent No.: US 12,042,834 B2
(45) Date of Patent: Jul. 23, 2024

(54) DEVICE FOR LOADING ROLLS AND INNER PARTS OF A ROLL STAND DURING CALIBRATION OF INDIVIDUAL ROLL CALIBERS

(71) Applicant: KOCKS Technik GmbH & Co KG, Hilden (DE)

(72) Inventor: Günter Schnug, Düsseldorf (DE)

(73) Assignee: KOCKS Technik GmbH & Co KG, Hilden (DE)

( * ) Notice: Subject to any disclaimer, the term of this patent is extended or adjusted under 35 U.S.C. 154(b) by 73 days.

(21) Appl. No.: 17/178,441

(22) Filed: Feb. 18, 2021

(65) Prior Publication Data

US 2021/0252572 A1 Aug. 19, 2021

(30) Foreign Application Priority Data

Feb. 19, 2020 (DE) ..... 10 2020 202 107.4

(51) Int. Cl.
*B21B 31/10* (2006.01)

(52) U.S. Cl.
CPC ..... *B21B 31/10* (2013.01)

(58) Field of Classification Search
CPC ..... B21B 31/10; B21B 31/103; B21B 31/16; B21B 31/20; B21B 31/22; B21B 31/32; B21B 31/28; B21B 31/106; B21B 31/30
See application file for complete search history.

(56) References Cited

U.S. PATENT DOCUMENTS 3,861,187 A * 1/1975 Leeuwestein ..... B21B 13/103 72/224
4,026,136 A * 5/1977 Pell ..... B21B 31/10 29/281.1
4,154,074 A * 5/1979 Sieurin ..... B21B 13/06 72/247
4,182,147 A * 1/1980 Brauer ..... B21B 13/005 72/224
4,277,967 A * 7/1981 Staat ..... B21C 1/26 72/224
4,313,325 A * 2/1982 Staat ..... B21C 1/26 72/224

(Continued)

FOREIGN PATENT DOCUMENTS

CN 104772187 A 7/2015
CN 204429915 U 7/2015

(Continued)

OTHER PUBLICATIONS

JP 10-192924A, Matsuda et al. Jul. 1998.*
Office Action for Chinese Application No. 202110181049.1, dated Oct. 24, 2022.

*Primary Examiner* — Edward T Tolan
(74) *Attorney, Agent, or Firm* — Wolf, Greenfield & Sacks, P.C.

(57) ABSTRACT

A loading device for loading a roll may be connected without play to a roll shaft and may be supported by at least one bearing in a roll stand for rolling metal rods, bars, wires, or pipes from a roll or stock material, and a roll stand comprising such a loading device. The loading device may be configured to exert a force for calibrating a position of the roll in the roll stand, which may simulate a load on the bearing during rolling by applying the force to the roll or roll shaft.

7 Claims, 2 Drawing Sheets

(56) References Cited

U.S. PATENT DOCUMENTS 4,569,217 A * 2/1986 Properzi ..... B21B 13/103 72/247
4,910,842 A * 3/1990 Brendel ..... F16C 13/026 100/162 B
5,022,318 A * 6/1991 Alich ..... B05C 1/0834 100/170
5,146,409 A * 9/1992 Atkinson ..... B21B 31/18 72/247
5,329,849 A * 7/1994 Roerig ..... F16C 13/026 72/241.6
5,524,470 A * 6/1996 Rozmus ..... B21B 31/18 72/247
5,693,186 A * 12/1997 Vallius ..... D21F 3/0218 100/153
5,775,154 A 7/1998 Haberkamm
5,949,684 A * 9/1999 Kirkwood-Azmat ..... B21B 31/16 700/148
6,439,021 B1 * 8/2002 Langeder ..... B21B 31/30 72/244
6,490,901 B2 * 12/2002 Potthoff ..... B21B 13/103 72/235
2007/0199358 A1 8/2007 Bindernagel et al.
2014/0182346 A1 7/2014 Marin et al.

FOREIGN PATENT DOCUMENTS

CN 205262655 U 5/2016
CN 107983779 A 5/2018
CN 207456656 U 6/2018
CN 109434058 A 3/2019
CN 209945600 U 1/2020
DE 22 59 143 A 6/1974
DE 195 00 336 A1 7/1996
DE 10 2006 009 173 A1 8/2007
EP 0728538 A1 * 8/1996 ..... B21B 35/141
GB 1 440 633 A1 6/1976

* cited by examiner

DEVICE FOR LOADING ROLLS AND INNER PARTS OF A ROLL STAND DURING CALIBRATION OF INDIVIDUAL ROLL CALIBERS

CROSS-REFERENCE

Foreign priority benefits are claimed under 35 U.S.C. § 119(a)-(d) of German Application No. DE 10 2020 202 107.4, filed Feb. 19, 2020, which is hereby incorporated by reference in its entirety.

FIELD

Aspects disclosed herein relate to a loading device for loading a roll which is connected without play to a roll shaft and which is supported by at least one bearing in a roll stand for rolling metal rods, bars, wires, or pipes from a roll or stock material. The loading device is configured to exert a force for calibrating a position of the roll in the roll stand, which in turn simulates a load during rolling on the bearing and on the parts of the roll stand involved in supporting the roll.

Further aspects relate to a roll stand for a roll block for rolling metal rods, bars, wires, or pipes from a roll or stock material, the roll stand includes at least one roll which is connected without play to a roll shaft, which is supported by at least one bearing in the roll stand, and which forms a caliber.

BACKGROUND

Roll stands may conventionally be designed with multiple rolls that are independent from one another and interchangeable. These rolls may be accommodated in the roll block in a stand housing and can be replaced with newly prepared roll stands in just a few minutes to maximize rolling mill efficiency and improve product quality.

Conventionally, a roll block includes a plurality of roll stand spaces arranged one behind the other along a roll axis in a stand housing, each roll stand space having one roll stand. The roll stands are typically individually exchangeable to allow adjustment of the desired diameter of the rods, bars, wires, or pipes to be rolled in a wide adjustment range. For example, eight, twelve, or more roll stands are available for a roll block with four roll stand spaces. The roll stands may be operated in permanent exchange in the roll block. The roll stands that are not in use are prepared for the next use in the stand workshop.

Roll stands and roll blocks are typically equipped with an external adjustment mechanism for the rolls. The so-called remote adjustment occurs either by an electric motor or by a hydraulically operated actuator, such as one or more hydraulic cylinders. These actuators can change the caliber, either directly during rolling or during a rolling break. The decision whether to correct the caliber is made either by the operator or by an automated system. Tolerances of 0.3 mm to 0.1 mm can be achieved by means of remote adjustment. A very precise calibration of the caliber is required for even better tolerances in the range of 0.1 mm or less.

SUMMARY

A loading device for loading a roll which is connected without play to a roll shaft and which is supported by at least one bearing in a roll stand for rolling metal rods, bars, wires or pipes from a roll material is configured to exert a force for calibrating a position of the roll in the roll stand, which force simulates a load during rolling on the bearing and on parts of the roll stand involved in supporting the roll. The loading device is also configured to apply the force to the roll shaft or to apply the force to the roll.

A roll stand for a roll block in a rolling mill for rolling metal rods, bars, wires or pipes from a roll material comprises at least one roll which is connected without play to a roll shaft and which is supported by at least one bearing in said roll stand and which forms a caliber and a loading device configured to exert a force for calibrating a position of the roll in the roll stand, which force simulates a load on the bearing of the roll shaft during rolling by applying the force to the roll shaft or by applying the force to the roll.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
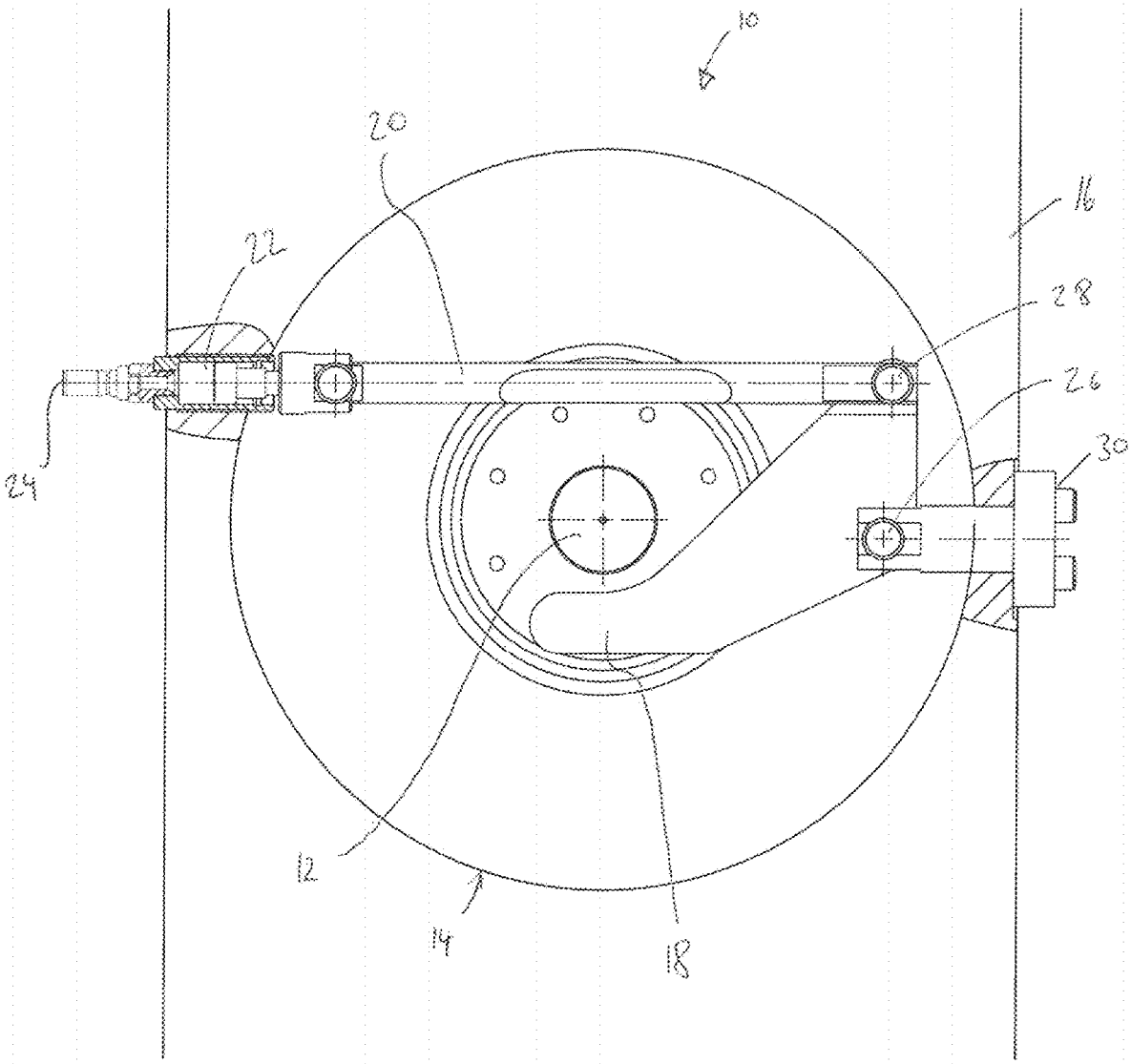
FIG. 1 is a side view of one embodiment of the loading device.

In rolling mills that produce rods, bars, wires, or pipes of various diameters, roll stands must be exchanged to accommodate the desired diameters. The typical adjustability of a single roll stand is conventionally limited to several millimeters in diameter. Therefore, an exchange of roll stands with an adapted set of rolls may be necessary, which may in turn, reduce the efficiency of the rolling mill and increase the duration of the rolling process.

In conventional roll stands with exchangeable rolls, the caliber profiles, are processed outside the roll stand. The finished rolls are then incorporated in a stand and calibrated axially and radially by a measuring system. The measuring system typically measured both the centers of the individual roll calibers, which may coincide precisely at a center point, and the entered caliber diameter corresponding to a precalculated setting value. During this calibration process, the roll stand has an orientation independent of its later orientation in the roll block. For example, a horizontal roll shaft can be arranged above or below the caliber. Depending on the position of the rolls, gravity may act during calibration in such a manner that the play (i.e., backlash or lost motion caused by a clearance) of the bearings of the roll shaft (which could also include the play and deformation of the parts of the roll stand involved in supporting the roll) undergoes a change in position once towards the caliber and once away from the caliber. Therefore, it may be possible that the rolls do not assume the position in the axial and radial direction in which they were measured during the rolling process. The resulting deviation in the caliber position can lead to marks on the roll material or tolerance deviations that are unpredictable and in any case undesirable.

In view of the above, the inventors have recognized the benefits of a loading device and a roll stand where the caliber of the roll stand can be reliably calibrated. The loading device and corresponding roll stand may also reduce the time and construction effort associated with the calibration of the rolls. The inventors have also recognized the benefits of a loading device and a roll stand in which a general calibration of the rolls is possible, i.e. which can be carried out independently of the geometry of the rolls to be calibrated, in particular the caliber diameter, caliber width, caliber radius and the presence of areas not yet belonging to the caliber. Lastly, the inventors have recognized the benefits of a loading device and a roll stand whereby the view of the caliber or other components required for calibration is not obstructed or blocked.

According to some embodiments, a loading device may be configured to apply a force to the roll shaft whereas in other embodiments, the loading device may be configured to apply the force to the roll.

Prior to calibrating the roll positions, some embodiments of the loading device may be mounted on a roll stand which may apply an external force directly to the rolls, which may simulate, to a certain extent, a load on the roll during the rolling process. Accordingly, a force may be applied to each roll, which causes the rolls to be pushed radially outward. As a result, the play in the bearing and the assembly are pushed away in similar manner to the rolling process, and the roll assumes with the caliber a position that approximately corresponds to the position assumed during the rolling process.

In some embodiments, the loading device acts on the rolls in such a manner that a direction of the force applied to the rolls may deviate slightly from the direction of the rolling force during the rolling process. It should be appreciated by those skilled in the art that calibration of the caliber may still be possible in this manner.

In some embodiments, the loading device may be configured to apply the force to the roll shaft, and not to the roll. In other embodiments, the loading device may be configured to apply the force to the roll.

In some embodiments, the loading device may be integrated in a roll stand. The roll stand may include the loading device which is configured to exert a force for calibrating a position of the roll in the roll stand, the force may then simulate a load on the bearing of the roll shaft during rolling by applying the force to the roll shaft or by applying the force to the roll.

In some embodiments, the roll stand may be configured to apply a force to the roll shaft, while in other embodiments, the roll stand may be configured to apply a force to the roll. It should be appreciated that the roll stand may apply the force partially to the roll shaft and partially to the roll, as the present disclosure is not so limited.

In embodiments where the roll stand applies the force to the roll shaft, the point of application of the force may be directly on the roll shaft. Accordingly, at least a significant portion if not all of the play on the bearings and bushings as well as play and deformation of parts of the roll stand involved in supporting the roll may be pushed away in the direction of the rolling force during calibration. This effect may occur irrespective of the geometry of the roll to be used as the force may not be not applied to the roll but rather to the respective roll shaft that is supported in the roll stand in the bearing or bearings to be viewed.

In some embodiments, when the force is applied to the roll shaft, it may be possible to align the direction of the force applied by the loading device such that it may be substantially similar to the direction of the force during the rolling process. In other embodiments, when the force is applied to the roll, the direction of the force may not correspond to the direction of the force during the rolling process, as the point of application of the force would have to be in the caliber. In these embodiments, the caliber may no longer be used as a reliable check of the calibration of the roll positions. In embodiments where the force is applied to the roll shaft, the direction of the force may be substantially similar in the calibration process and the rolling process. Alternatively, it may be possible to perform calibration of the caliber by applying the force to the roll.

In embodiments where the force is applied to the roll shaft instead of to the roll, it may be possible to dispense with the installation of a separate loading device for the rolls and the assembly and disassembly effort associated herewith. In some embodiments, the loading device may be integrated into the roll stand and remain there for an extensive period of time as it may not act on the roll and may therefore be arranged and dimensioned in such a manner that it is not in the way or intrusive during the rolling process. Accordingly, the calibration time of the rolls may be reduced.

By applying the force to the roll shaft, the caliber may be viewed without interference and the roll position may be calibrated without the loading device obstructing the view of the caliber or interfering with or blocking the execution of calibration.

In some embodiments, the roll stand includes at least three rolls which may be arranged a roll axis in a star shape, and are each connected without play to a roll shaft and are supported by at least one bearing each in the roll stand. The roll stand and roll shaft together form the caliber, a loading device arranged on each of the roll shafts, which may be configured to exert a force for calibrating a position of each respective roll in the roll stand. As described previously, this force may simulate a load on the bearing of the respective roll shaft during rolling by applying the force to the respective roll shaft.

While in some embodiments, the roll stand may only have one roll to be calibrated, in other embodiments, the roll stand may have three, four or more rolls arranged around the roll axis. While in some embodiments, the arrangement of the rolls around the roll axis may be a star shape, any suitable arrangement of the rolls around the roll axis may be used as the present disclosure is not so limited. It should be appreciated that the roll stand may include any suitable number of rolls, including but not limited to, one, two, three, four, five, six, seven, or eight rolls, as the present disclosure is not so limited.

In some embodiments, the loading device may be configured to be operated externally by an operator while in other embodiments, the loading device may be configured to be operated by an automated system. It should be appreciated that the loading device may be configured for any suitable mode of operation, as the present disclosure is not so limited.

In one embodiment, the loading device is configured to apply the force applied by a hydraulic cylinder, through a threaded spindle or via the movement of suitably shaped components, such as wedges. These elements also allow suitably large forces to be applied to the roll shaft. It should be appreciated that suitably large rolling forces may enable highly realistic simulation of the involved plays. It should be appreciated that the force may be applied to the roll shaft by other any suitable elements, for example electric actuators.

In one embodiment, the loading device is movable such that after calibrating the position, it can be moved into a configuration where it releases the roll shaft and all other parts of the roll stand used for rolling. After the calibration process, the loading device can thus be moved into a position that does not interfere with the inner parts of the stand during the rolling operation. It should be appreciated that this position may include all positions that may be assumed by the inner parts of the stand as a result of the stand positioning, i.e. the adjustment of the caliber, as the present disclosure is not so limited.

In another embodiment of the roll stand with an adjustment device for radially adjusting the position of the roll or rolls in order to change the size of the caliber, the loading device is configured to exert a force in each position of the roll or rolls for calibrating the position of the respective roll in the roll stand. In some embodiments, this force may simulate a load on the bearing of the respective roll shaft during rolling by applying the force to the respective roll shaft. Calibration may accordingly be carried out over the entire adjustment range of the roll stand, which may lead to a particularly precise calibration of the caliber since it may be carried out directly for all relevant positions of the rolls.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 shows a partial side view of one embodiment of the loading device 10 and a roll shaft 12, on which a roll 14 is mounted without play, the roll shaft 12 being supported together with the roll 14 by at least one bearing (not shown) in a roll stand 16 for rolling metal rods, bars, wires, or pipes from a roll or stock material.

In some embodiments, the loading device 10 may be configured to exert a force for calibrating a position of the roll 14 in the roll stand 16. The force may then simulate a load during rolling on the bearing and on the parts of the roll stand 16 involved in supporting the roll 14. In the embodiment according to FIG. 1, the force application element 18 is arranged and configured below the roll shaft 12 such that an upward force can be applied to the roll shaft 12 by moving the force application element 18. In other embodiments, the force may be externally applied to the roll 14, as the present disclosure is not so limited.

As shown in FIG. 1, in one embodiment of the loading device, a roll 14 may exert a downward force during the rolling operation. In other words, the rolling of roll 14 may result in resistance from the roll or stock material in an upward direction, i.e. in a similar direction as the force direction exerted by the force application element 18.

In some embodiments, the force application element 18 may be supported by a stand joint 26, which may be attached to the roll stand 16 by an attachment element 30. Furthermore, a knee joint 28 may be located on one side of the force application element 18, which in some embodiments may be opposite a contact area of the force application element 18 with the roller shaft 12 relative to the stand joint 26. The knee joint 28 may connect the force application element 18 to the push rod 20.

In some embodiments, the push rod 20 may be externally supplied with pressure via a hydraulic cylinder 22, as shown in FIG. 1. Accordingly, the push rod 20 may move to the proximal to the roll shaft 12 such that the force application element 18 moves clockwise around the stand joint 26, thereby coming into contact with the roll shaft 12 to push it upward. In some embodiments, the loading device 10 may further include a hydraulic connection 24, which may supply the hydraulic cylinder 22 with pressure and through which hydraulic pressure may be externally applied to the hydraulic cylinder 22. As soon as the pressure in the hydraulic cylinder 22 subsides, the force application element 18 may be pivoted anticlockwise, back into a position in which it leaves the roll shaft 12 and the roll 14 enough free space for operation during rolling.

It should be appreciated that the restoring motion of the force application element 18 may be applied by a spring and/or a force applied by the roll shaft 12 or any other suitable element, as the present disclosure is not so limited. The restoring may also be achieved by configuring the hydraulic cylinder 22 as a double-acting hydraulic cylinder 22 such that when sufficient pressure is applied, the push rod 20 may move to the left in FIG. 1. In embodiments of the roll stand 16 in which the roll 14 is radially adjustable so as to roll different calibers and roll geometries, the loading device 10 may be able to move far enough away from the roll shaft 12 such that the roll shaft 12 may operate in any setting position without interference.

While the loading device 10 is shown to be integrated in the roll stand 16 in FIG. 1, in some embodiments, is the loading device 10 may be externally attached to the roll stand 16, as the present disclosure is not so limited.

Figure 2:
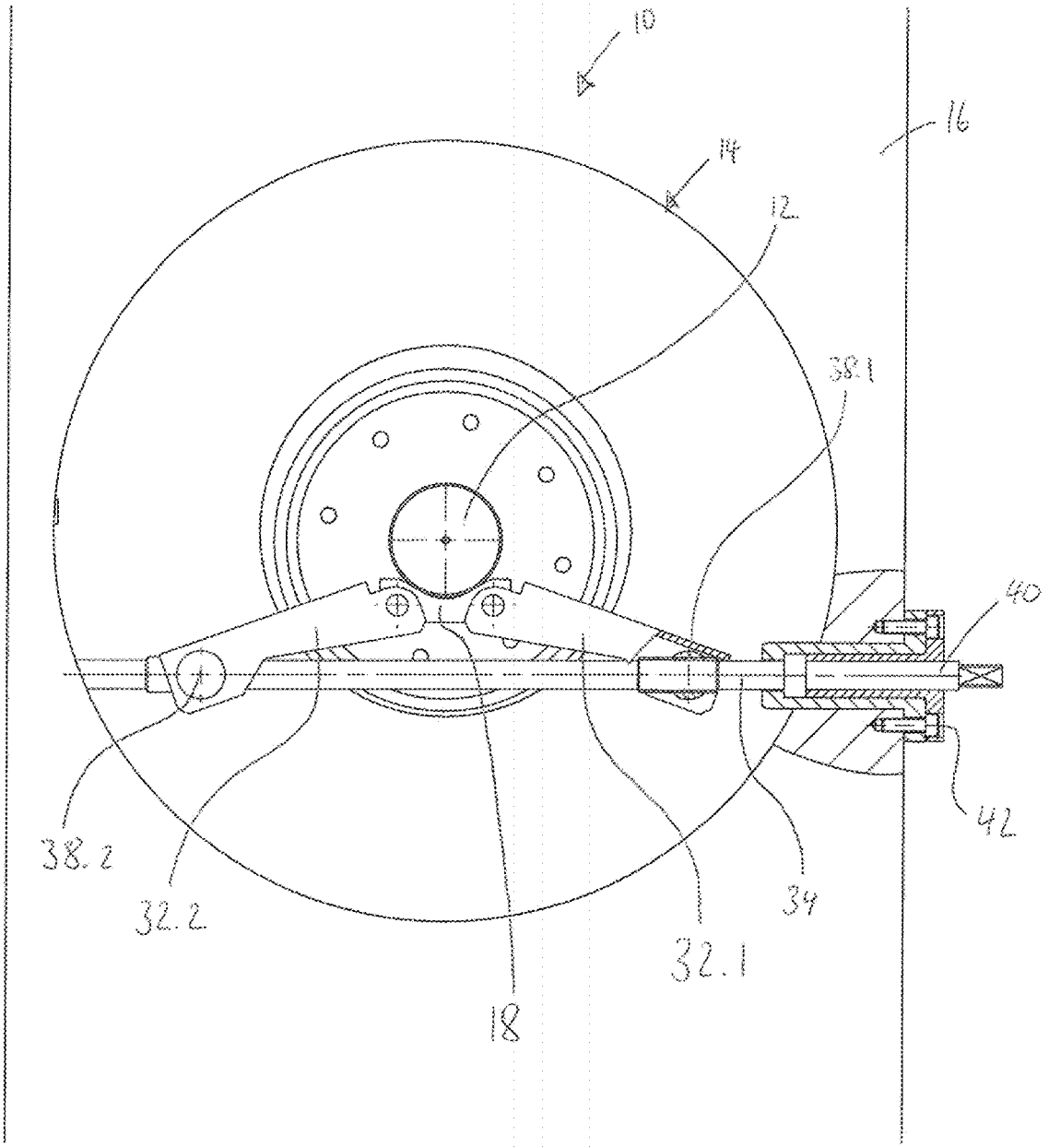
FIG. 2 is a side view of another embodiment of the loading device.

While FIG. 1 and FIG. 2 each show a section of a roll stand 16 in which only one roll 14 is located, in some embodiments, a corresponding loading device 10 may, of course, also be provided for further rolls 14 in the roll stand 16 and may be capable of calibrating the caliber with respect to all rolls. The loading devices 10 may thereby be synchronized and also set to the same force across the rolls, for example by applying a common hydraulic pressure to the respective hydraulic cylinder 22.

FIG. 2 shows another embodiment of a loading device 10 where the force application element 18 is configured with a threaded spindle 34 driven by a threaded spindle connection 40. The threaded spindle 34 may be attached to the roll stand 16 inter alia with an attachment element 42.

By turning the threaded spindle 34, two nuts 38.1, 38.2 provided with an internal thread, may move along the axial direction of the threaded spindle 34 in a manner similar to a jack or pallet jack, for example. The nuts 38.1, 38.2 may thereby move towards or away from each other depending on the direction of rotation of the threaded spindle 34. Attached to the nuts 38.1, 38.2 may be push rods 32.1, 32.2, which may be connected to one another with the force application element 18.

In some embodiments, the threaded spindle 34 and the push rods 32.1, 32.2 together form a sort of triangle, the longest side of which may be formed by the threaded spindle 34 and may change its extension such that the threaded spindle 34 may be externally acted upon via the threaded spindle connection 40. As a result, the force application element 18 (as shown in FIG. 2) may be moved up or down, thus exerting or relieving a force on the roll shaft 12.

In any embodiment, the force for simulating the load on the bearing (not shown) and on the parts of the roll stand 16 involved in supporting the roll 14 may be applied directly to the roll shaft 12. Accordingly, the caliber may be freely visible and the calibration process may proceed undisturbed. It should be appreciated that any other suitable mechanisms for applying the force to the roll shaft 12 or the roll 14 may be used, for example a wedge mechanism, as the present disclosure is not so limited.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Thus, it should also be appreciated that features described herein as being part of one or more embodiments may be combined with or removed from other embodiments, as the present disclosure invention is not limited to any particular embodiment having any particular feature. Accordingly, the foregoing description and drawings are by way of example only.

What is claimed is:

1. A loading device for a loading a roll, wherein the roll is connected without play to a roll shaft, wherein the roll shaft is supported by means of at least one bearing in a roll stand for rolling metal rods, bars, wires or pipes from a roll material, wherein said loading device is configured to exert a radial force for calibrating a radial position of the roll in the roll stand, wherein the radial force simulates a load during rolling on the bearing and on parts of the roll stand involved in supporting the roll, wherein the loading device is configured to apply the radial force to the roll shaft or to apply the radial force to the roll, and wherein the loading device is configured to apply the radial force with one of a hydraulic cylinder, at least one push rod driven by a threaded spindle, or via the movement of wedges.

2. The loading device according to claim 1, wherein said loading device is integrated in the roll stand.

3. A roll stand or a roll block in a rolling mill for rolling metal rods, bars, wires or pipes from a roll material, the roll stand comprising:

at least one roll, wherein the roll is connected without play to a roll shaft, wherein the roll shaft is supported by at least one bearing in the roll stand, wherein the roll forms a calibre, and a loading device configured to exert a radial force for calibrating a radial position of the roll in the roll stand, wherein the radial force simulates a load on the bearing of the roll shaft during rolling by applying the radial force to the roll shaft or by applying the radial force to the roll, and wherein the loading device is configured to apply the radial force with one of a hydraulic cylinder, at least one push rod driven by a threaded spindle, or via the movement of wedges.

4. The roll stand according to claim 3, wherein said roll stand comprises at least three rolls which surround a roll axis in a star shape, are each connected without play to a roll shaft and are supported by means of at least one bearing each in the roll stand, and which together form the calibre, wherein a loading device is arranged on each of the roll shafts, said loading device being configured to exert a force for calibrating a position of the respective roll in the roll stand, which force simulates a load on the bearing of the respective roll shaft during rolling by applying the force to the respective roll shaft.

5. The roll stand according to claim 3 or 4, wherein the loading device is configured to be externally operated by an operator.

6. The roll stand according to claim 3, wherein the loading device is movable such that, after calibrating the position, it can be moved into a configuration where it releases the roll shaft and all other parts of the roll stand used for rolling.

7. The roll stand according to claim 3, wherein said roll stand comprises an adjustment device for radially adjusting the position of the roll or rolls so as to change the size of the calibre, wherein the loading device is configured to exert a force in each position of the roll or rolls for calibrating the position of the respective roll in the roll stand, which force simulates a load on the bearing of the respective roll shaft during rolling by applying the force to the respective roll shaft.

* * * * *